US009123990B2

(12) United States Patent
Ramachandran et al.

(10) Patent No.: US 9,123,990 B2
(45) Date of Patent: Sep. 1, 2015

(54) MULTI-FEED ANTENNA APPARATUS AND METHODS

(75) Inventors: Prasadh Ramachandran, Oulu (FI); Ari Raappana, Kello (FI); Petteri Annamaa, Oulunsalo (FI)

(73) Assignee: Pulse Finland OY, Kempele (FI)

( * ) Notice: Subject to any disclaimer, the term of this patent is extended or adjusted under 35 U.S.C. 154(b) by 24 days.

(21) Appl. No.: 13/269,490

(22) Filed: Oct. 7, 2011

(65) Prior Publication Data

US 2013/0088404 A1 Apr. 11, 2013

(51) Int. Cl.

| | |
|---|---|
| ***H01Q 1/24*** | (2006.01) |
| ***H01Q 7/00*** | (2006.01) |
| ***H01Q 9/42*** | (2006.01) |
| ***H01Q 5/40*** | (2015.01) |

(52) U.S. Cl.

CPC ..... *H01Q 1/243* (2013.01); *H01Q 5/40* (2015.01); *H01Q 7/00* (2013.01); *H01Q 9/42* (2013.01)

(58) Field of Classification Search

CPC ..... H01Q 7/00; H01Q 1/243; H01Q 1/38; H01Q 21/28; H01Q 9/42; H01Q 5/0062; H01Q 13/10; H01Q 5/0058; H01Q 9/26; H01Q 5/00; H01Q 1/52

USPC ..... 343/853, 858, 855, 700 MS, 702; 333/100, 124, 129

See application file for complete search history.

(56) References Cited

U.S. PATENT DOCUMENTS 2,745,102 A 5/1956 Norgorden 3,938,161 A 2/1976 Sanford (Continued)

FOREIGN PATENT DOCUMENTS

| | | |
|---|---|---|
| CN | 1316797 | 10/2007 |
| DE | 10104862 | 8/2002 |

(Continued)

OTHER PUBLICATIONS

Zhi Ning Chen, Broadband Planar Antennas Design and Applications, 2006, John Wiley & Sons Inc., 1st, pp. 135, 136, 139, and 145.*

(Continued)

*Primary Examiner* — Hoang V Nguyen
*Assistant Examiner* — Patrick Holecek
(74) *Attorney, Agent, or Firm* — Gazdzinski & Associates PC

(57) ABSTRACT

A space efficient multi-feed antenna apparatus, and methods for use in a radio frequency communications device. In one embodiment, the antenna assembly comprises three (3) separate radiator structures disposed on a common antenna carrier. Each of the three antenna radiators is connected to separate feed ports of a radio frequency front end. In one variant, the first and the third radiators comprise quarter-wavelength planar inverted-L antennas (PILA), while the second radiator comprises a half-wavelength grounded loop-type antenna disposed in between the first and the third radiators. The PILA radiators are characterized by radiation patterns having maximum radiation axes that are substantially perpendicular to the antenna plane. The loop radiator is characterized by radiation pattern having axis of maximum radiation that is parallel to the antenna plane. The above configuration of radiating patterns advantageously isolates the first radiator structure from the third radiator structure in at least one frequency band.

16 Claims, 8 Drawing Sheets

(56) References Cited

U.S. PATENT DOCUMENTS 4,004,228 A 1/1977 Mullett
4,028,652 A 6/1977 Wakino et al.
4,031,468 A 6/1977 Ziebell et al.
4,054,874 A 10/1977 Oltman, Jr.
4,069,483 A 1/1978 Kaloi
4,123,756 A 10/1978 Nagata et al.
4,123,758 A 10/1978 Shibano et al.
4,131,893 A 12/1978 Munson et al.
4,201,960 A 5/1980 Skutta et al.
4,255,729 A 3/1981 Fukasawa et al.
4,313,121 A 1/1982 Campbell et al.
4,356,492 A 10/1982 Kaloi
4,370,657 A 1/1983 Kaloi
4,423,396 A 12/1983 Makimoto et al.
4,431,977 A 2/1984 Sokola et al.
4,546,357 A 10/1985 Laughon et al.
4,559,508 A 12/1985 Nishikawa et al.
4,625,212 A 11/1986 Oda et al.
4,653,889 A 3/1987 Haneishi
4,661,992 A 4/1987 Garay et al.
4,692,726 A 9/1987 Green et al.
4,703,291 A 10/1987 Nishikawa et al.
4,706,050 A 11/1987 Andrews
4,716,391 A 12/1987 Moutrie et al.
4,740,765 A 4/1988 Ishikawa et al.
4,742,562 A 5/1988 Kommrusch
4,761,624 A 8/1988 Igarashi et al.
4,800,348 A 1/1989 Rosar et al.
4,800,392 A 1/1989 Garay et al.
4,821,006 A 4/1989 Ishikawa et al.
4,823,098 A 4/1989 DeMuro et al.
4,827,266 A 5/1989 Sato et al.
4,829,274 A 5/1989 Green et al.
4,835,538 A 5/1989 McKenna et al.
4,835,541 A 5/1989 Johnson et al.
4,862,181 A 8/1989 PonceDeLeon et al.
4,879,533 A 11/1989 De Muro et al.
4,896,124 A 1/1990 Schwent
4,907,006 A 3/1990 Nishikawa et al.
4,954,796 A 9/1990 Green et al.
4,965,537 A 10/1990 Kommrusch
4,977,383 A 12/1990 Niiranen
4,980,694 A 12/1990 Hines
5,016,020 A 5/1991 Simpson
5,017,932 A 5/1991 Ushiyama et al.
5,043,738 A 8/1991 Shapiro et al.
5,047,739 A 9/1991 Kuokkanene
5,053,786 A 10/1991 Silverman et al.
5,057,847 A 10/1991 Vaeisaenen
5,061,939 A 10/1991 Nakase
5,097,236 A 3/1992 Wakino et al.
5,103,197 A 4/1992 Turunen
5,109,536 A 4/1992 Kommrusch
5,155,493 A 10/1992 Thursby et al.
5,157,363 A 10/1992 Puurunen
5,159,303 A 10/1992 Flink
5,166,697 A 11/1992 Viladevall et al.
5,170,173 A 12/1992 Krenz et al.
5,203,021 A 4/1993 Repplinger et al.
5,210,510 A 5/1993 Karsikas
5,210,542 A 5/1993 Pett et al.
5,220,335 A 6/1993 Huang
5,229,777 A 7/1993 Doyle
5,239,279 A 8/1993 Turunen
5,278,528 A 1/1994 Turunen
5,281,326 A 1/1994 Galla
5,298,873 A 3/1994 Ala-Kojola
5,302,924 A 4/1994 Jantunen
5,304,968 A 4/1994 Ohtonen
5,307,036 A 4/1994 Turunen
5,319,328 A 6/1994 Turunen
5,349,315 A 9/1994 Ala-Kojola
5,349,700 A 9/1994 Parker
5,351,023 A 9/1994 Niiranen
5,354,463 A 10/1994 Turunen
5,355,142 A 10/1994 Marshall et al.
5,357,262 A 10/1994 Blaese
5,363,114 A 11/1994 Shoemaker
5,369,782 A 11/1994 Kawano et al.
5,382,959 A 1/1995 Pett et al.
5,386,214 A 1/1995 Sugawara
5,387,886 A 2/1995 Takalo
5,394,162 A 2/1995 Korovesis et al.
RE34,898 E 4/1995 Turunen
5,408,206 A 4/1995 Turunen
5,418,508 A 5/1995 Puurunen
5,432,489 A 7/1995 Yrjola
5,438,697 A 8/1995 Fowler et al.
5,440,315 A 8/1995 Wright et al.
5,442,366 A 8/1995 Sanford
5,444,453 A 8/1995 Lalezari
5,467,065 A 11/1995 Turunen
5,473,295 A 12/1995 Turunen
5,506,554 A 4/1996 Ala-Kojola
5,508,668 A 4/1996 Prokkola
5,510,802 A 4/1996 Tsuru et al.
5,517,683 A 5/1996 Collett et al.
5,521,561 A 5/1996 Yrjola
5,526,003 A 6/1996 Ogawa et al.
5,532,703 A 7/1996 Stephens et al.
5,541,560 A 7/1996 Turunen
5,541,617 A 7/1996 Connolly et al.
5,543,764 A 8/1996 Turunen
5,550,519 A 8/1996 Korpela
5,557,287 A 9/1996 Pottala et al.
5,557,292 A 9/1996 Nygren et al.
5,566,441 A 10/1996 Marsh et al.
5,570,071 A 10/1996 Ervasti
5,585,771 A 12/1996 Ervasti
5,585,810 A 12/1996 Tsuru et al.
5,589,844 A 12/1996 Belcher et al.
5,594,395 A 1/1997 Niiranen
5,604,471 A 2/1997 Rattila
5,627,502 A 5/1997 Ervasti
5,649,316 A 7/1997 Prudhomme et al.
5,668,561 A 9/1997 Perrotta et al.
5,675,301 A 10/1997 Nappa
5,689,221 A 11/1997 Niiranen
5,694,135 A 12/1997 Dikun et al.
5,696,517 A 12/1997 Kawahata et al.
5,703,600 A 12/1997 Burrell et al.
5,709,832 A 1/1998 Hayes et al.
5,711,014 A 1/1998 Crowley et al.
5,717,368 A 2/1998 Niiranen
5,731,749 A 3/1998 Yrjola
5,734,305 A 3/1998 Ervasti
5,734,350 A 3/1998 Deming et al.
5,734,351 A 3/1998 Ojantakanen
5,739,735 A 4/1998 Pyykko
5,742,259 A 4/1998 Annamaa
5,757,327 A 5/1998 Yajima et al.
5,760,746 A 6/1998 Kawahata
5,764,190 A 6/1998 Murch et al.
5,767,809 A 6/1998 Chuang et al.
5,768,217 A 6/1998 Sonoda et al.
5,777,581 A 7/1998 Lilly et al.
5,777,585 A 7/1998 Tsuda et al.
5,793,269 A 8/1998 Ervasti
5,797,084 A 8/1998 Tsuru et al.
5,812,094 A 9/1998 Maldonado
5,815,048 A 9/1998 Ala-Kojola
5,822,705 A 10/1998 Lehtola
5,852,421 A 12/1998 Maldonado
5,861,854 A 1/1999 Kawahata et al.
5,874,926 A 2/1999 Tsuru et al.
5,880,697 A 3/1999 McCarrick et al.
5,886,668 A 3/1999 Pedersen et al.
5,892,490 A 4/1999 Asakura et al.
5,903,820 A 5/1999 Hagstrom
5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Maeda et al.

(56) References Cited

U.S. PATENT DOCUMENTS 5,943,016 A 8/1999 Snyder, Jr. et al.
5,952,975 A 9/1999 Pedersen et al.
5,959,583 A 9/1999 Funk
5,963,180 A 10/1999 Leisten
5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.
5,986,608 A 11/1999 Korisch et al.
5,990,848 A 11/1999 Annamaa
5,999,132 A 12/1999 Kitchener et al.
6,005,529 A 12/1999 Hutchinson
6,006,419 A 12/1999 Vandendolder
6,008,764 A 12/1999 Ollikainen et al.
6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.
6,037,848 A 3/2000 Alila
6,043,780 A 3/2000 Funk et al.
6,052,096 A 4/2000 Tsuru et al.
6,072,434 A 6/2000 Papatheodorou
6,078,231 A 6/2000 Pelkonen
6,091,363 A 7/2000 Komatsu et al.
6,091,365 A 7/2000 Derneryd et al.
6,097,345 A 8/2000 Walton
6,100,849 A 8/2000 Tsubaki et al.
6,112,108 A 8/2000 Tepper et al.
6,121,931 A 9/2000 Levi et al.
6,133,879 A 10/2000 Grangeat et al.
6,134,421 A 10/2000 Lee et al.
6,140,966 A 10/2000 Pankinaho
6,140,973 A 10/2000 Annamaa
6,147,650 A 11/2000 Kawahata et al.
6,157,819 A 12/2000 Vuokko
6,177,908 B1 1/2001 Kawahata
6,185,434 B1 2/2001 Hagstrom
6,190,942 B1 2/2001 Wilm et al.
6,195,049 B1 2/2001 Kim et al.
6,204,826 B1 3/2001 Rutkowski et al.
6,215,376 B1 4/2001 Hagstrom et al.
6,246,368 B1 6/2001 Deming et al.
6,252,552 B1 6/2001 Tarvas et al.
6,252,554 B1 6/2001 Isohatala
6,255,994 B1 7/2001 Saito
6,259,029 B1 7/2001 Chen et al.
6,268,831 B1 7/2001 Sanford
6,281,848 B1 8/2001 Nagumo et al.
6,297,776 B1 10/2001 Pankinaho
6,304,220 B1 10/2001 Herve et al.
6,308,720 B1 10/2001 Modi
6,316,975 B1 11/2001 O'Toole et al.
6,323,811 B1 11/2001 Tsubaki
6,326,921 B1 12/2001 Egorov et al.
6,337,663 B1 1/2002 Chi-Minh
6,340,954 B1 1/2002 Annamaa et al.
6,342,859 B1 1/2002 Kurz et al.
6,343,208 B1 1/2002 Ying
6,346,914 B1 2/2002 Annamaa
6,348,892 B1 2/2002 Annamaa
6,353,443 B1 3/2002 Ying
6,366,243 B1 4/2002 Isohatala
6,377,827 B1 4/2002 Rydbeck
6,380,905 B1 4/2002 Annamaa
6,396,444 B1 5/2002 Goward
6,404,394 B1 6/2002 Hill
6,417,813 B1 7/2002 Durham et al.
6,421,014 B1 7/2002 Sanad
6,423,915 B1 7/2002 Winter
6,429,818 B1 8/2002 Johnson et al.
6,452,551 B1 9/2002 Chen
6,452,558 B1 9/2002 Saitou et al.
6,456,249 B1 9/2002 Johnson et al.
6,459,413 B1 10/2002 Tseng et al.
6,462,716 B1 10/2002 Kushihi
6,469,673 B2 10/2002 Kaiponen
6,473,056 B2 10/2002 Annamaa
6,476,767 B2 11/2002 Aoyama et al.
6,476,769 B1 11/2002 Lehtola
6,480,155 B1 11/2002 Eggleston
6,483,462 B2 11/2002 Weinberger
6,498,586 B2 12/2002 Pankinaho
6,501,425 B1 12/2002 Nagumo
6,515,625 B1 2/2003 Johnson
6,518,925 B1 2/2003 Annamaa
6,529,168 B2 3/2003 Mikkola
6,529,749 B1 3/2003 Hayes et al.
6,535,170 B2 3/2003 Sawamura et al.
6,538,604 B1 3/2003 Isohatala
6,538,607 B2 3/2003 Barna
6,542,050 B1 4/2003 Arai et al.
6,549,167 B1 4/2003 Yoon
6,552,686 B2 4/2003 Ollikainen et al.
6,556,812 B1 4/2003 Pennanen et al.
6,566,944 B1 5/2003 Pehlke
6,580,396 B2 6/2003 Lin
6,580,397 B2 6/2003 Lindell
6,600,449 B2 7/2003 Onaka
6,603,430 B1 8/2003 Hill et al.
6,606,016 B2 8/2003 Takamine et al.
6,606,071 B2 * 8/2003 Cheng et al. ..... 343/767
6,611,235 B2 8/2003 Barna et al.
6,614,400 B2 9/2003 Egorov
6,614,401 B2 9/2003 Onaka et al.
6,614,405 B1 9/2003 Mikkonen
6,634,564 B2 10/2003 Kuramochi
6,636,181 B2 10/2003 Asano
6,639,564 B2 10/2003 Johnson
6,646,606 B2 11/2003 Mikkola
6,650,295 B2 11/2003 Ollikainen et al.
6,657,593 B2 12/2003 Nagumo et al.
6,657,595 B1 12/2003 Phillips et al.
6,670,926 B2 12/2003 Miyasaka
6,677,903 B2 1/2004 Wang
6,680,705 B2 1/2004 Tan et al.
6,683,573 B2 1/2004 Park
6,693,594 B2 2/2004 Pankinaho et al.
6,717,551 B1 4/2004 Desclos et al.
6,727,857 B2 4/2004 Mikkola
6,734,825 B1 5/2004 Guo et al.
6,734,826 B1 5/2004 Dai et al.
6,738,022 B2 5/2004 Klaavo et al.
6,741,214 B1 5/2004 Kadambi et al.
6,753,813 B2 6/2004 Kushihi
6,759,989 B2 7/2004 Tarvas et al.
6,765,536 B2 7/2004 Phillips et al.
6,774,853 B2 8/2004 Wong et al.
6,781,545 B2 8/2004 Sung
6,801,166 B2 10/2004 Mikkola
6,801,169 B1 10/2004 Chang et al.
6,806,835 B2 10/2004 Iwai
6,819,287 B2 11/2004 Sullivan et al.
6,819,293 B2 11/2004 De Graauw
6,825,818 B2 11/2004 Toncich
6,836,249 B2 12/2004 Kenoun et al.
6,847,329 B2 1/2005 Ikegaya et al.
6,856,293 B2 2/2005 Bordi
6,862,437 B1 3/2005 McNamara
6,862,441 B2 3/2005 Ella
6,873,291 B2 3/2005 Aoyama
6,876,329 B2 4/2005 Milosavljevic
6,882,317 B2 4/2005 Koskiniemi
6,891,507 B2 5/2005 Kushihi et al.
6,897,810 B2 5/2005 Dai et al.
6,900,768 B2 5/2005 Iguchi et al.
6,903,692 B2 6/2005 Kivekas
6,911,945 B2 6/2005 Korva
6,922,171 B2 7/2005 Annamaa
6,925,689 B2 8/2005 Folkmar
6,927,729 B2 8/2005 Legay
6,937,196 B2 8/2005 Korva
6,950,065 B2 9/2005 Ying et al.

(56) References Cited

U.S. PATENT DOCUMENTS 6,950,066 B2 9/2005 Hendler et al.
6,950,068 B2 9/2005 Bordi
6,950,072 B2 9/2005 Miyata et al.
6,952,144 B2 10/2005 Javor
6,952,187 B2 10/2005 Annamaa
6,958,730 B2 10/2005 Nagumo et al.
6,961,544 B1 11/2005 Hagstrom
6,963,308 B2 11/2005 Korva
6,963,310 B2 11/2005 Horita
6,967,618 B2 11/2005 Ojantakanen
6,975,278 B2 12/2005 Song et al.
6,980,158 B2 12/2005 Iguchi et al.
6,985,108 B2 1/2006 Mikkola
6,992,543 B2 1/2006 Luetzelschwab et al.
6,995,710 B2 2/2006 Sugimoto et al.
7,023,341 B2 4/2006 Stilp
7,031,744 B2 4/2006 Kuriyama et al.
7,034,752 B2 4/2006 Sekiguchi et al.
7,042,403 B2 5/2006 Colburn et al.
7,053,841 B2 5/2006 Ponce De Leon et al.
7,054,671 B2 5/2006 Kaiponen et al.
7,057,560 B2 6/2006 Erkocevic
7,061,430 B2 6/2006 Zheng et al.
7,081,857 B2 7/2006 Kinnunen et al.
7,084,831 B2 8/2006 Takagi et al.
7,099,690 B2 8/2006 Milosavljevic
7,113,133 B2 9/2006 Chen et al.
7,119,749 B2 10/2006 Miyata et al.
7,126,546 B2 10/2006 Annamaa
7,129,893 B2 10/2006 Otaka et al.
7,136,019 B2 11/2006 Mikkola
7,136,020 B2 11/2006 Yamaki
7,142,824 B2 11/2006 Kojima et al.
7,148,847 B2 12/2006 Yuanzhu
7,148,849 B2 12/2006 Lin
7,148,851 B2 12/2006 Takaki et al.
7,170,464 B2 1/2007 Tang et al.
7,176,838 B1 2/2007 Kinezos
7,180,455 B2 2/2007 Oh et al.
7,193,574 B2 3/2007 Chiang et al.
7,205,942 B2 4/2007 Wang et al.
7,215,283 B2 5/2007 Boyle
7,218,280 B2 5/2007 Annamaa
7,218,282 B2 5/2007 Humpfer et al.
7,224,313 B2 5/2007 McKinzie, III et al.
7,230,574 B2 6/2007 Johnson
7,233,775 B2 6/2007 De Graauw
7,237,318 B2 7/2007 Annamaa
7,256,743 B2 8/2007 Korva
7,274,334 B2 9/2007 O'Riordan et al.
7,283,097 B2 10/2007 Wen et al.
7,289,064 B2 10/2007 Cheng
7,292,200 B2 11/2007 Posluszny et al.
7,319,432 B2 1/2008 Andersson
7,330,153 B2 2/2008 Rentz
7,333,067 B2 2/2008 Hung et al.
7,339,528 B2 3/2008 Wang et al.
7,340,286 B2 3/2008 Korva et al.
7,345,634 B2 3/2008 Ozkar et al.
7,352,326 B2 4/2008 Korva
7,355,270 B2 4/2008 Hasebe et al.
7,358,902 B2 4/2008 Erkocevic
7,375,695 B2 5/2008 Ishizuka et al.
7,381,774 B2 6/2008 Bish et al.
7,382,319 B2 6/2008 Kaunari et al.
7,385,556 B2 6/2008 Chung et al.
7,388,543 B2 6/2008 Vance
7,391,378 B2 6/2008 Mikkola
7,405,702 B2 7/2008 Annamaa et al.
7,417,588 B2 8/2008 Castany et al.
7,423,592 B2 9/2008 Pros et al.
7,432,860 B2 10/2008 Huynh
7,439,929 B2 10/2008 Ozkar
7,443,344 B2 10/2008 Boyle
7,468,700 B2 12/2008 Milosavlejevic
7,468,709 B2 12/2008 Niemi
7,469,131 B2 * 12/2008 Nail et al. ..... 455/168.1
7,498,990 B2 3/2009 Park et al.
7,501,983 B2 3/2009 Mikkola
7,502,598 B2 3/2009 Kronberger
7,589,678 B2 9/2009 Perunka et al.
7,616,158 B2 11/2009 Mark et al.
7,633,449 B2 12/2009 Oh
7,660,562 B2 * 2/2010 Onno et al. ..... 455/114.1
7,663,551 B2 2/2010 Nissinen
7,679,565 B2 3/2010 Sorvala
7,683,839 B2 * 3/2010 Ollikainen et al. ..... 343/702
7,692,543 B2 4/2010 Copeland
7,710,325 B2 5/2010 Cheng
7,724,204 B2 5/2010 Annamaa
7,760,146 B2 7/2010 Ollikainen
7,764,245 B2 7/2010 Loyet
7,786,938 B2 8/2010 Sorvala
7,800,544 B2 9/2010 Thornell-Pers
7,830,327 B2 11/2010 He
7,843,397 B2 11/2010 Boyle
7,889,139 B2 2/2011 Hobson et al.
7,889,143 B2 2/2011 Milosavljevic
7,901,617 B2 3/2011 Taylor
7,903,035 B2 3/2011 Mikkola et al.
7,916,086 B2 3/2011 Koskiniemi et al.
7,963,347 B2 6/2011 Pabon
7,973,720 B2 7/2011 Sorvala
8,049,670 B2 11/2011 Jung et al.
8,098,202 B2 1/2012 Annamaa et al.
8,179,322 B2 5/2012 Nissinen
8,193,998 B2 6/2012 Puente et al.
8,378,892 B2 2/2013 Sorvala et al.
8,466,756 B2 6/2013 Milosavljevic et al.
8,473,017 B2 6/2013 Milosavljevic et al.
8,531,337 B2 * 9/2013 Soler Castany et al. ..... 343/702
8,564,485 B2 10/2013 Milosavljevic et al.
8,629,813 B2 1/2014 Milosavljevic
2001/0050636 A1 12/2001 Weinberger
2002/0183013 A1 12/2002 Auckland et al.
2002/0196192 A1 12/2002 Nagumo et al.
2003/0146873 A1 8/2003 Blancho
2004/0090378 A1 5/2004 Dai et al.
2004/0137950 A1 7/2004 Bolin et al.
2004/0145525 A1 7/2004 Annabi et al.
2004/0171403 A1 9/2004 Mikkola
2005/0057401 A1 3/2005 Yuanzhu
2005/0159131 A1 7/2005 Shibagaki et al.
2005/0176481 A1 8/2005 Jeong
2006/0071857 A1 4/2006 Pelzer
2006/0192723 A1 8/2006 Harada
2007/0042615 A1 2/2007 Liao
2007/0082789 A1 4/2007 Nissila
2007/0152881 A1 7/2007 Chan
2007/0188388 A1 8/2007 Feng
2008/0055164 A1 3/2008 Zhang et al.
2008/0059106 A1 3/2008 Wight
2008/0088511 A1 4/2008 Sorvala
2008/0158068 A1 * 7/2008 Huang et al. ..... 343/700 MS
2008/0266199 A1 10/2008 Milosavljevic
2009/0009415 A1 1/2009 Tanska
2009/0135066 A1 5/2009 Raappana et al.
2009/0174604 A1 7/2009 Keskitalo
2009/0196160 A1 8/2009 Crombach
2009/0197654 A1 8/2009 Teshima
2009/0231213 A1 9/2009 Ishimiya
2010/0220016 A1 9/2010 Nissinen
2010/0244978 A1 9/2010 Milosavljevic
2010/0309092 A1 12/2010 Lambacka
2011/0133994 A1 6/2011 Korva
2012/0119955 A1 5/2012 Milosavljevic et al.

FOREIGN PATENT DOCUMENTS

DE 10150149 4/2003
EP 0 208 424 1/1987
EP 0 376 643 4/1990
EP 0 751 043 4/1997
EP 0 807 988 11/1997

(56) References Cited

FOREIGN PATENT DOCUMENTS

| | | |
|---|---|---|
| EP | 0 831 547 | 3/1998 |
| EP | 0 851 530 | 7/1998 |
| EP | 1 294 048 | 1/1999 |
| EP | 1 014 487 | 6/2000 |
| EP | 1 024 553 | 8/2000 |
| EP | 1 067 627 | 1/2001 |
| EP | 0 923 158 | 9/2002 |
| EP | 1 329 980 | 7/2003 |
| EP | 1 361 623 | 11/2003 |
| EP | 1 406 345 | 4/2004 |
| EP | 1 453 137 | 9/2004 |
| EP | 1 220 456 | 10/2004 |
| EP | 1 467 456 | 10/2004 |
| EP | 1 753 079 | 2/2007 |
| FI | 20020829 | 11/2003 |
| FI | 118782 | 3/2008 |
| FR | 2553584 | 10/1983 |
| FR | 2724274 | 3/1996 |
| FR | 2873247 | 1/2006 |
| GB | 2266997 | 11/1993 |
| GB | 2360422 | 9/2001 |
| GB | 2389246 | 12/2003 |
| JP | 59-202831 | 11/1984 |
| JP | 60-206304 | 10/1985 |
| JP | 61-245704 | 11/1986 |
| JP | 06-152463 | 5/1994 |
| JP | 07-131234 | 5/1995 |
| JP | 07-221536 | 8/1995 |
| JP | 07-249923 | 9/1995 |
| JP | 07-307612 | 11/1995 |
| JP | 08-216571 | 8/1996 |
| JP | 09-083242 | 3/1997 |
| JP | 09-260934 | 10/1997 |
| JP | 09-307344 | 11/1997 |
| JP | 10-028013 | 1/1998 |
| JP | 10-107671 | 4/1998 |
| JP | 10-173423 | 6/1998 |
| JP | 10-209733 | 8/1998 |
| JP | 10-224142 | 8/1998 |
| JP | 10-322124 | 12/1998 |
| JP | 10-327011 | 12/1998 |
| JP | 11-004113 | 1/1999 |
| JP | 11-004117 | 1/1999 |
| JP | 11-068456 | 3/1999 |
| JP | 11-127010 | 5/1999 |
| JP | 11-127014 | 5/1999 |
| JP | 11-136025 | 5/1999 |
| JP | 11-355033 | 12/1999 |
| JP | 2000-278028 | 10/2000 |
| JP | 2001-053543 | 2/2001 |
| JP | 2001-267833 | 9/2001 |
| JP | 2001-217631 | 10/2001 |
| JP | 2001-326513 | 11/2001 |
| JP | 2002-319811 | 10/2002 |
| JP | 2002-329541 | 11/2002 |
| JP | 2002-335117 | 11/2002 |
| JP | 2003-060417 | 2/2003 |
| JP | 2003-124730 | 4/2003 |
| JP | 2003-179426 | 6/2003 |
| JP | 2004-112028 | 4/2004 |
| JP | 2004-363859 | 12/2004 |
| JP | 2005-005985 | 1/2005 |
| JP | 2005-252661 | 9/2005 |
| KR | 20010080521 | 10/2001 |
| KR | 20020096016 | 12/2002 |
| SE | 511900 | 12/1999 |
| WO | WO 92/00635 | 1/1992 |
| WO | WO 96/27219 | 9/1996 |
| WO | WO 98/01919 | 1/1998 |
| WO | WO 99/30479 | 6/1999 |
| WO | WO 01/20718 | 3/2001 |
| WO | WO 01/29927 | 4/2001 |
| WO | WO 01/33665 | 5/2001 |
| WO | WO 01/61781 | 8/2001 |
| WO | WO 2004/017462 | 2/2004 |
| WO | WO 2004/057697 | 7/2004 |
| WO | WO 2004/100313 | 11/2004 |
| WO | WO 2004/112189 | 12/2004 |
| WO | WO 2005/062416 | 7/2005 |
| WO | WO 2007/012697 | 2/2007 |
| WO | WO 2010/122220 | 10/2010 |

OTHER PUBLICATIONS

Wang Xiaoyong, A Norvel Power Allocation Algorithm Under CoMP With CA, Oct. 20, 2009, IEEE, vol. 2, p. 66.*

"An Adaptive Microstrip Patch Antenna for Use in Portable Transceivers", Rostbakken et al., Vehicular Technology Conference, 1996, Mobile Technology for The Human Race, pp. 339-343.

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

Abedin, M. F. and M. Ali, "Modifying the ground plane and its erect on planar inverted-F antennas (PTEAs) for mobile handsets," *IEEE Antennas and Wireless Propagation Letters,* vol. 2, 226-229, 2003.

C. R. Rowell and R. D. Murch, "A compact PIFA suitable for dual frequency 900/1800-MHz operation," *IEEE Trans. Antennas Propag.,* vol. 46, No. 4, pp. 596-598, Apr. 1998.

Cheng- Nan Hu, Willey Chen, and Book Tal, "A Compact Multi-Band Antenna Design for Mobile Handsets", *APMC 2005 Proceedings*.

Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.

European Office Action, May 30, 2005 issued during prosecution of EP 04 396 001.2-1248.

Examination Report dated May 3, 2006 issued by the EPO for European Patent Application No. 04 396 079.8.

F.R. Hsiao, et al. "A dual-band planar inverted-F patch antenna with a branch-line slit," *Microwave Opt. Technol. Lett.,* vol. 32, Feb. 20, 2002.

Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.

Guo, Y. X. and H. S. Tan, "New compact six-band internal antenna," *IEEE Antennas and Wireless Propagation Letters,* vol. 3, 295-297, 2004.

Guo, Y. X. and Y.W. Chia and Z. N. Chen, "Miniature built-in quadband antennas for mobile handsets", *IEEE Antennas Wireless Propag. Lett.,* vol. 2, pp. 30-32, 2004.

Hoon Park, et al. "Design of an Internal antenna with wide and multiband characteristics for a mobile handset", *IEEE Microw. & Opt. Tech. Lett.* vol. 48, No. 5, May 2006.

Hoon Park, et al. "Design of Planar Inverted-F Antenna With Very Wide Impedance Bandwidth", *IEEE Microw. & Wireless Comp., Lett.,* vol. 16, No. 3, pp. 113-115-, Mar. 2006.

Hossa, R., A. Byndas, and M. E. Bialkowski, "Improvement of compact terminal antenna performance by incorporating open-end slots in ground plane," *IEEE Microwave and Wireless Components Letters,* vol. 14, 283-285, 2004.

I. Ang, Y. X. Guo, and Y. W. Chia, "Compact internal quad-band antenna for mobile phones" *Micro. Opt. Technol. Lett.,* vol. 38, No. 3 pp. 217-223 Aug. 2003.

International Preliminary Report on Patentability for International Application No. PCT/FI2004/000554, date of issuance of report May 1, 2006.

(56) References Cited

OTHER PUBLICATIONS

Jing, X., et al.; "Compact Planar Monopole Antenna for Multi-Band Mobile Phones"; Microwave Conference Proceedings, 4,-7.12.2005. APMC 2005, Asia- Pacific Conference Proceedings, vol. 4.
Kim, B. C., J. H. Yun, and H. D. Choi, "Small wideband PIFA for mobile phones at 1800 MHz," *IEEE International Conference on Vehicular Technology,* 27{29, Daejeon, South Korea, May 2004.
Kim, Kihong et al., "Integrated Dipole Antennas on Silicon Substrates for Intra-Chip Communication", IEEE, pp. 1582-1585, 1999.
Kivekas., O., J. Ollikainen, T. Lehtiniemi, and P. Vainikainen, "Bandwidth, SAR, and eciency of internal mobile phone antennas," *IEEE Transactions on Electromagnetic Compatibility,* vol. 46, 71{86, 2004.
K-L Wong, *Planar Antennas for Wireless Communications,* Hoboken, NJ: Willey, 2003, ch. 2.
Lindberg., P. and E. Ojefors, "A bandwidth enhancement technique for mobile handset antennas using wavetraps," *IEEE Transactions on Antennas and Propagation,* vol. 54, 2226{2232, 2006.
Marta Martinez-Vazquez, et al., "Integrated Planar Multiband Antennas for Personal Communication Handsets", *IEEE Trasactions on Antennas and propagation,* vol. 54, No. 2, Feb. 2006.
P. Ciais, et al., "Compact Internal Multiband Antennas for Mobile and WLAN Standards", *Electronic Letters,* vol. 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp. Lett.,* vol. 14, No. 4, pp. 148-150, Apr. 2004.
P. Salonen, et al. "New slot configurations for dual-band planar inverted-F antenna," *Microwave Opt. Technol.,* vol. 28, pp. 293-298, 2001.
Papapolymerou, Ioannis et al., "Micromachined Patch Antennas", *IEEE Transactions on Antennas and Propagation,* vol. 46, No. 2, pp. 275-283, Feb. 1998.
Product of the Month, RFDesign, "GSM/GPRS Quad Band Power Amp Includes Antenna Switch," 1 page, reprinted Nov. 2004 issue of RF Design (www.rfdesign.com), Copyright 2004, Freescale Semiconductor, RFD-24-EK.
S. Tarvas, et al. "An internal dual-band mobile phone antenna," in *2000 IEEE Antennas Propagat, Soc. Int. Symp. Dig.,* pp. 266-269, Salt Lake City, UT, USA.
Wang, F., Z. Du, Q. Wang, and K. Gong, "Enhanced-bandwidth PIFA with T-shaped ground plane," *Electronics Letters,* vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. '03, vol. 51, No. 1.
X.-D. Cai and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Joshi, Ravi K., et al., "Broadband Concentric Rings Fractal Slot Antenna", XXVIIIth General Assembly of International Union of Radio Science (URSI). (Oct. 23-29, 2005), 4 Pgs.
Singh, Rajender, "Broadband Planar Monopole Antennas," M.Tech credit seminar report, Electronic Systems group, EE Dept, IIT Bombay, Nov. 2003, pp. 1-24.
Gobien, Andrew, T. "Investigation of Low Profile Antenna Designs for Use in Hand-Held Radios," Ch.3, *The Inverted-L Antenna and Variations;* Aug. 1997, pp. 42-76.
See, C.H., et al., "Design of Planar Metal-Plate Monopole Antenna for Third Generation Mobile Handsets," Telecommunications Research Centre, Bradford University, 2005, pp. 27-30.
Chen, Jin-Sen, et al., "CPW-fed Ring Slot Antenna with Small Ground Plane," Department of Electronic Engineering, Chong Shiu University.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for Wlan Applications," Dept. of Electrical Engineering, National Sun Yat-Sen University, 2002 09 Ansoft Workshop, pp. 1-45.
"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.
Extended European Search Report dated Jan. 30, 2013, issued by the EPO for EP Patent Application No. 12177740.3.

* cited by examiner

MULTI-FEED ANTENNA APPARATUS AND METHODS

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The present invention relates generally to antenna apparatus for use within electronic devices such as wireless radio devices, and more particularly in one exemplary aspect to a multi-band long term evolution (LTE) or LTE-Advanced antenna, and methods of tuning and utilizing the same.

DESCRIPTION OF RELATED TECHNOLOGY

Internal antennas are an element found in most modern radio devices, such as mobile computers, mobile phones, Blackberry® devices, smartphones, personal digital assistants (PDAs), or other personal communication devices (PCDs). Typically, these antennas comprise a planar radiating plane and a ground plane parallel thereto, which are connected to each other by a short-circuit conductor in order to achieve the matching of the antenna. The structure is configured so that it functions as a resonator at the desired operating frequency. It is also a common requirement that the antenna operate in more than one frequency band (such as dual-band, tri-band, or quad-band mobile phones), in which case two or more resonators are used.

Increased proliferation of long term evolution (LTE) mobile data services creates an increased demand for compact multi-band antennas typically used in mobile radio devices, such as cellular phones. Typically, it is desired for an LTE-compliant radio device to support operation in multiple frequency bands (such as, for example, 698 MHz to 960 MHz, 1710 MHz to 1990 MHz, 2110 MHz to 2170 MHz, and 2500 MHz to 2700 MHz). Furthermore, radio devices will need to continue to support legacy 2G, 3G, and 3G+ air interface standards, in addition to supporting LTE (and ultimately LTE-A). Additionally, implementation of the various air interface standards vary from network operator and/or region based on the various spectrums implemented, such as for example in the case of inter-band carrier aggregation, which comprises receiving data simultaneously on two or more carriers located in different frequency bands. The two frequency bands allocated vary based on geographic region, as well as the spectrum owned by the particular network operator, thereby creating a multitude of possible band pair implementations.

Typical mobile radio devices implement a single-feed portioned RF front-end. The single-feed RF front-end normally includes one single-pole multi-throw antenna switch with a high number of throws connected to the different filters or diplexers to support the various modes of operation. Therefore, by increasing the number of modes of operation supported by the device, additional circuitry is required, which is problematic given both the increasing size constraints of mobile radio devices, and the desire for reduced cost and greater simplicity (for, e.g., reliability). In order for a single-feed RF-front end to support inter-band carrier aggregation, diplexers for the two frequency bands need to be simultaneously connected to the antenna feed. This is achieved by modifying the antenna control logic to have two simultaneously active switch throws. Hardwired duplexer matching is required between the antenna switch throws and the band duplexers. Different matching would be required for different combinations of inter-band carrier aggregation pairs, therefore making single-feed RF front-end impractical to support the various specific band pair implementations.

Accordingly, there is a salient need for a small form-factor radio frequency antenna solution which enables various operator-specific frequency band operational configurations using the same hardware.

SUMMARY OF THE INVENTION

The present invention satisfies the foregoing needs by providing, inter alia, a space-efficient multi-feed antenna apparatus and methods of tuning and use thereof.

In a first aspect of the invention, a multi-feed antenna apparatus is disclosed. In one embodiment, the antenna apparatus includes a first antenna element operable in a first frequency region, first antenna element comprising a first radiator and a first feed portion, the first feed portion configured to be coupled to a first feed port, a second antenna element operable in at least a second frequency region and a third frequency region. The second antenna element includes a second radiator, a second feed portion configured to be coupled to a second feed port, and a third feed portion configured to be coupled to a third feed port. In one variant, the second frequency region includes a first carrier frequency and the third frequency region includes a second carrier frequency, and the second and the third feed portions cooperate to: (i) enable inter-carrier aggregation of the first carrier and the second carrier into a single band, and (ii) to obviate diplexer matching specific to the single band.

In another embodiment, a triple-feed antenna apparatus is disclosed which includes a first antenna element operable in a lower frequency band and comprising a first feed portion configured to be coupled to a first feed port, a second antenna element operable in a second frequency band and comprising a second feed portion configured to be coupled to a second feed port, and a third antenna element operable in an upper frequency band and comprising a third feed portion configured to be coupled to a third feed port. The first and third antenna elements are each configured to form a radiation pattern disposed primarily in a first orientation, and the second antenna element is configured to form a radiation pattern disposed primarily in a second orientation that is substantially orthogonal to the first.

In one variant, the antenna apparatus includes a matching network.

In another variant, the first, second and third antenna elements are disposed on a common carrier, at least a portion of the carrier being configured substantially parallel to a ground plane, the radiation pattern of the first and third antenna elements each comprise an axis of maximum radiation that is substantially perpendicular to the ground plane, and the radiation pattern of the second antenna element includes an axis of maximum radiation substantially parallel to the ground plane.

In another variant, the first antenna element and the third antenna element each comprise a quarter-wavelength planar inverted-L antenna (PILA), and the second antenna element includes a half-wavelength loop antenna.

In yet another variant, the antenna apparatus includes a common carrier, the common carrier having a dielectric element having a plurality of surfaces, the first antenna element and the third antenna element are disposed at least partly on a first surface of the plurality of surfaces, and the second antenna element is disposed at least partly on a second surface of the plurality of surfaces, the second surface being disposed substantially parallel to a ground plane of the antenna apparatus, and the first surface being disposed substantially perpendicular to the ground plane.

In a second aspect of the invention, a radio frequency communications device is disclosed. In one embodiment, the radio frequency device includes an electronics assembly comprising a ground plane and one or more feed ports, and a multiband antenna apparatus. The antenna apparatus includes a first antenna structure comprising a first radiating element and a first feed portion coupled to a first feed port, a second antenna structure comprising a second radiating element and a second feed portion coupled to a second feed port, and a third antenna structure comprising an third radiating element and a third feed portion coupled to a third feed port.

In one variant, the second antenna structure and second feed port are disposed substantially between the first and third antenna structures, and the antenna apparatus is disposed proximate a bottom end of the ground plane.

In another variant, the first and third radiating elements have radiation patterns which are substantially orthogonal to a radiation pattern of the second radiating element, and the substantially orthogonal radiation patterns provide sufficient antenna isolation between each radiating element to enable operation of the device in at least three distinct radio frequency bands.

In a third aspect of the invention, matching network for use with a multi-feed antenna apparatus is disclosed. In one embodiment, the matching network includes first, second, and third matching circuits configured to couple a radio frequency front-end to first, second, and third feeds, respectively, and the first, second, and third matching circuits each enable tuning of respective ones of antenna radiators to desired frequency bands.

In another embodiment, the matching network includes first, second and third matching circuits configured to couple a radio frequency transceiver to first, second, and third feeds, respectively, and the first, second, and third matching circuits each provide impedance matching to a feed structure of the transceiver by at least increasing input resistance of the first, second, and third feeds.

In another embodiment, the matching network includes first, second and third matching circuits configured to couple a radio frequency front-end to first, second, and third feeds, respectively, and wherein the first, second, and third matching circuits each provide band-pass filtration, such filtration ensuring low coupling between respective ones of first, second, and third radiators.

In a fourth aspect of the invention, a method of tuning a multi-feed antenna is disclosed. In one embodiment, the multi-feed antenna includes first, second and third radiating elements and associated first, second, and third feed ports and matching circuits, and the method includes tuning a reactance of at least one of the matching circuits so as to create a dual resonance response in the radiating element associated therewith.

In one variant, the tuning is accomplished via at least selection of one or more capacitance values within the at least one matching circuit.

In another variant, the first and the third radiating elements each comprise a planar inverted-L antenna (PILA)-type element, and the tuning a reactance of at least one matching circuit includes tuning the reactance associated with the first and the third circuits so as to produce multiple frequency bands within the emissions of the first and the third elements.

In a fifth aspect of the invention, a method of radiator isolation for use in a multi-feed antenna apparatus of a radio frequency device is disclosed. In one embodiment, the multi-feed antenna apparatus includes first, second, and third antenna radiating elements, and at least first, second, and third feed portions, and the method includes electrically coupling the first feed point to the first radiating element, the coupling configured to effect a first radiation pattern having maximum sensitivity along a first axis, and electrically coupling the second feed point to the second radiating element, the electric coupling configured to effect a second radiation pattern having maximum sensitivity along a second axis. The third feed portion is also electrically coupled to the third radiating element. The foregoing coupling configured to effect a third radiation pattern having maximum sensitivity along the first axis.

In one variant the second axis is configured orthogonal to the first axis, and the axis configurations cooperate to effect isolation of the first radiating element from the third radiating element.

In a sixth aspect of the invention, a method of using a multiband antenna apparatus is disclosed.

Further features of the present invention, its nature and various advantages will be more apparent from the accompanying drawings and the following detailed description.

BRIEF DESCRIPTION OF THE DRAWINGS

The features, objectives, and advantages of the invention will become more apparent from the detailed description set forth below when taken in conjunction with the drawings, wherein.

Figure 1:
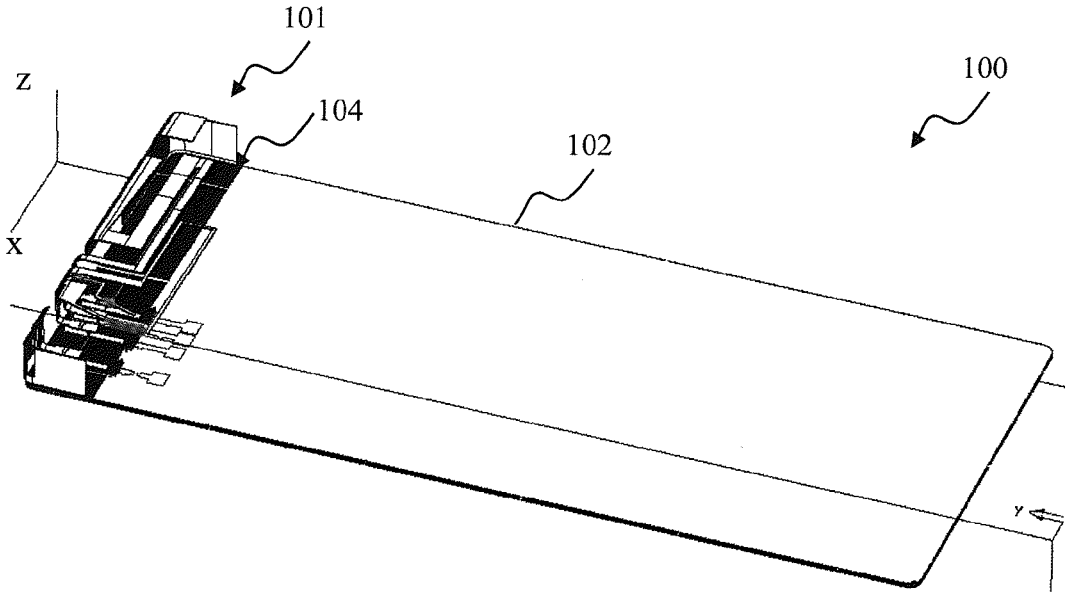
FIG. 1 is an isometric view depicting placement of the triple-feed antenna apparatus placement on a portable device printed circuit board according to one embodiment of the present invention.

All Figures disclosed herein are © Copyright 2011 Pulse Finland Oy. All rights reserved.

DETAILED DESCRIPTION OF THE PREFERRED EMBODIMENT

Reference is now made to the drawings wherein like numerals refer to like parts throughout.

As used herein, the terms "antenna," "antenna system," "antenna assembly", and "multi-band antenna" refer without limitation to any apparatus or system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

The terms "frequency range", "frequency band", and "frequency domain" refer without limitation to any frequency range for communicating signals. Such signals may be communicated pursuant to one or more standards or wireless air interfaces.

As used herein, the terms "portable device", "mobile computing device", "client device", "portable computing device", and "end user device" include, but are not limited to, personal computers (PCs) and minicomputers, whether desktop, laptop, or otherwise, set-top boxes, personal digital assistants (PDAs), handheld computers, personal communicators, tablet computers, portable navigation aids, J2ME equipped devices, cellular telephones, smartphones, personal integrated communication or entertainment devices, or literally any other device capable of interchanging data with a network or another device.

Furthermore, as used herein, the terms "radiator," "radiating plane," and "radiating element" refer without limitation to an element that can function as part of a system that receives and/or transmits radio-frequency electromagnetic radiation; e.g., an antenna or portion thereof.

The terms "RF feed," "feed," "feed conductor," and "feed network" refer without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the terms "loop" and "ring" refer generally and without limitation to a closed (or virtually closed) path, irrespective of any shape or dimensions or symmetry.

As used herein, the terms "top", "bottom", "side", "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, CDPD, satellite systems such as GPS, millimeter wave or microwave systems, optical, acoustic, and infrared (i.e., IrDA).

Overview

The present invention provides, in one salient aspect, a multi-feed (e.g., triple-feed) antenna apparatus for use with a radio device the antenna advantageously providing reduced size and cost, as well as improved antenna performance suitable for serving multiple operational needs using the same hardware configuration.

In one embodiment, the antenna assembly includes three (3) separate radiator structures disposed on a common antenna carrier or substrate. Each of the three antenna radiators is connected to separate feed ports of a radio device radio frequency front end. In this embodiment, the first and the third radiators (that are connected to the first and third feed ports, respectively) comprise quarter-wavelength planar inverted-L antennas (PILA). The second radiator (connected to the second feed port) includes a half-wavelength grounded loop-type antenna, and is disposed in between the first and the third radiators. In one implementation, the second radiator further includes a slot structure, configured to effect resonance in the desired frequency band.

The first radiator is in the exemplary embodiment configured to operate in a lower frequency band (LFB), while the second radiator structure is configured to operate in multiple frequency bands. The third radiator is configured to operate in an upper frequency band (UFB).

The exemplary PILA radiators are characterized by radiation patterns having axes of maximum radiation that are perpendicular to the antenna plane (the carrier plane). The loop radiator is characterized by radiation pattern having an axis of maximum radiation that is parallel to the antenna plane. The above configuration of radiating patterns advantageously isolates the third radiator structure from the first radiator structure. In one variant, the third radiator structure is isolated from the second radiator structure over at least one frequency band.

By placing the loop radiator structure in between the two PILA structures, and the second feed between the first and third feeds, significant isolation of the first and third radiators from one another is achieved, thereby enhancing the performance of the antenna apparatus.

The exemplary multi-feed antenna apparatus and RF front-end also advantageously enable inter-band carrier aggregation. In one implementation, each of the aggregated bands is supported by a separate antenna radiator (for example, the second and the third radiators). In another implementation, the inter-band aggregation is achieved using the same element for both bands (for example, the third antenna radiator).

DETAILED DESCRIPTION OF EXEMPLARY EMBODIMENTS

Detailed descriptions of the various embodiments of the apparatus and methods of the invention are now provided. While primarily discussed in the context of radio devices useful with LTE or LTE-A wireless communications systems, the various apparatus and methodologies discussed herein are not so limited. In fact, many of the apparatus and methodologies of the invention are useful in any number of complex antennas, whether associated with mobile or fixed devices that can benefit from the multi-feed antenna methodologies and apparatus described herein.

Exemplary Antenna Apparatus

Figure 2:
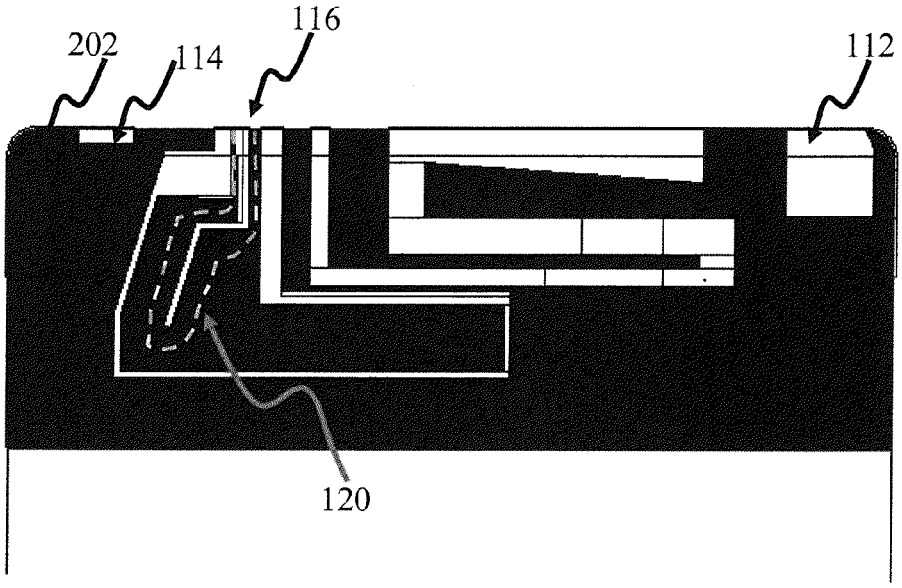
FIG. 2 is top elevation view showing a carrier and radiating elements of the triple-feed antenna apparatus in accordance with one embodiment of the present invention.

Referring now to FIGS. 1 through 2B, various exemplary embodiments of the triple-feed antenna apparatus of the invention are described in detail.

One exemplary embodiment of a multiband antenna apparatus 100 for use with a radio device is presented in FIG. 1, which shows an isometric view of the multi-feed antenna assembly 101 attached to a common printed circuit board (PCB) 102 carrier. The exemplary PCB 102 in this instance comprises a rectangle of about 100 mm (3.94 in.) in length, and about 50 mm (1.97 in.) in width. The PCB 102 further comprises a conductive coating (e.g., a copper-based alloy) deposited on the top planar face of the substrate element, so as to form a ground plane, depicted as the black area denoted by the reference number 104 in FIG. 1.

Figure 1A:
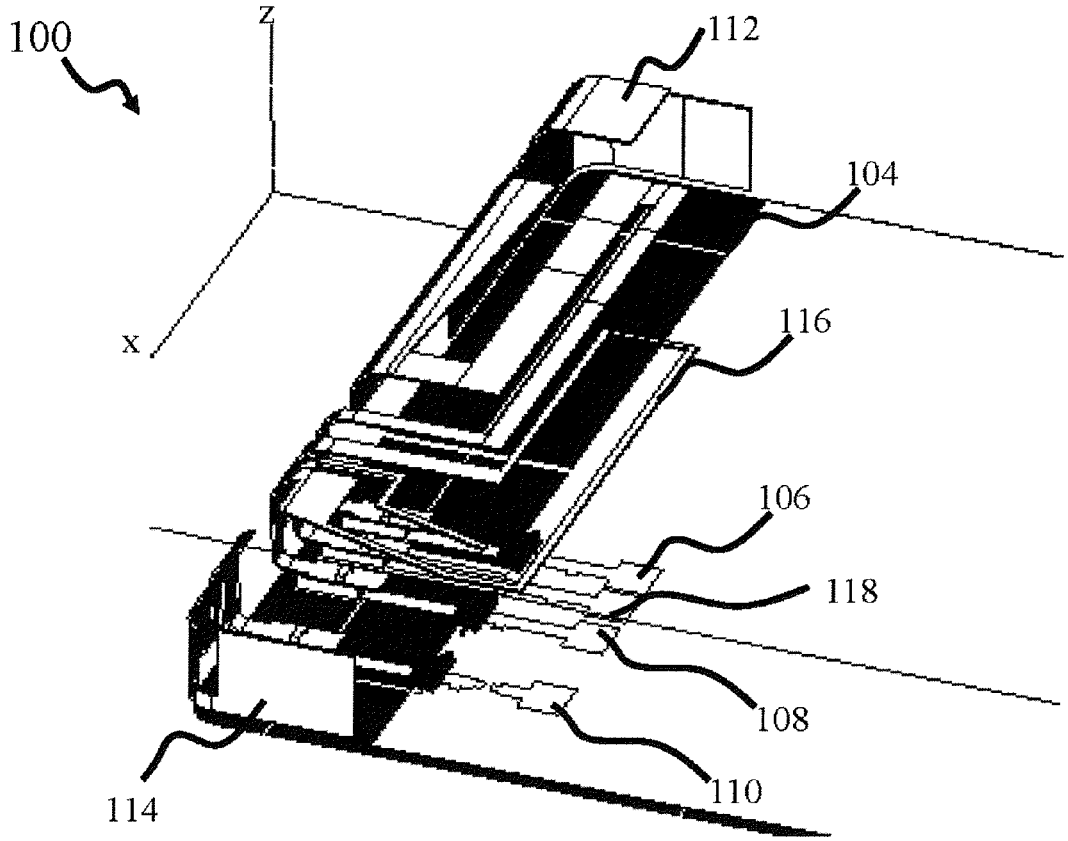
FIG. 1A is an isometric view further detailing the triple-feed antenna apparatus of the embodiment of FIG. 1.

A detailed configuration of the multi-feed antenna assembly 101 is shown in FIG. 1A. The antenna assembly 101 comprises three separate radiator structures 112, 114, 116 disposed on a common antenna carrier (not visible in FIG. 1A, for clarity). Each of the three antenna radiators 112, 114, 116 is connected to separate feed ports 106, 108, 110, respectively, of a radio device radio frequency front end.

In one variant, the first feed port 106 covers a frequency range of approximately 700-960 MHz, known in LTE as the "Low Band". The second feed port 108 covers approximately 1,425-1,505 MHz (band 11) as well as 2.3-2.7 GHz (bands 7, 40, and 41). The third feed port 110 is designed to cover approximately 1,710-2,170 MHz (high band). The exemplary bands referenced above are configured according to Evolved Universal Terrestrial Radio Access (E-UTRA) air interface specification, described in the 3rd Generation Partnership Project (3GPP) Technical Specification Group Radio Access Network (E-UTRA), 3GPP TS 36 series, incorporated herein by reference in its entirety. As will be appreciated by those skilled in the art, the above frequency band references and bounds may be varied or adjusted from one implementation to another based on specific design requirements and parameters, such as for example antenna size, target country or wireless carrier of operation, etc. Furthermore, embodiments of the present invention may be used with the High Speed Packet Access (HSPA) and 3GPP Evolved HSPA wireless communications networks, described in the 3rd Generation Partnership Project (3GPP) Technical Specification Group Universal Mobile Telecommunications System (UMTS);), 3GPP TS 25 series, incorporated herein by reference in its entirety. Typically, each of the operational frequency ranges may support one or more distinct frequency bands configured in accordance with the specifications governing the relevant wireless application system (such as, for example, HSPA, HSPA+, LTE/LTE-A, or GSM).

The multi-feed antenna apparatus and RF front-end (such as shown and described with respect to FIG. 1A) advantageously enable inter-band carrier aggregation. In one implementation, each of the aggregated bands is supported by a separate antenna radiator (for example, the second and the third radiators). In another implementation, the inter-band aggregation is achieved using the same antenna for both bands (for example, the third antenna). Notably, both configurations are supported using the same hardware configuration, and without requiring modification to the antenna switching logic (such as, for example, enabling two throws active at the same time), as separate feeds of the antenna 100 are used for different frequency bands.

The antenna configuration of the embodiment shown in FIG. 1 alleviates the need for band-pair specific duplexer matching, as required by the single-feed RF front-end and antenna implementations of prior art, as the needed isolation between the bands is provided by the separation of the antennas. As a brief aside, duplexer pair matching would still be a required in those implementations where the inter-band pair is close enough in frequency such that the same antenna would be used to receive both band pairs (e.g., band pair 2 and 4).

The first 112 and the third 114 radiators shown in the embodiment of FIG. 1A each (that are connected to the first and third feed ports, respectively) comprise quarter-wavelength planar inverted-L antennas (PILA). The second radiator (connected to the second feed port) comprises a half-wavelength grounded loop-type antenna, and is disposed in between the first and the third radiators. In one implementation, the second radiator further comprises a slot structure, configured to effect resonance in the desired frequency band. It will be appreciated that while PILA and loop-type antenna elements are selected for the first/third and second elements of the embodiment of FIG. 1, respectively, other types and/or combinations of antennas may be used consistent with the invention.

As shown in the embodiment of FIG. 1A, the radiator element 112 coupled to the first feed port 106 comprises a quarter-wavelength planar inverted-L antenna (PILA) structure disposed proximate to the corner edge of the PCB 102. The radiator element 114 coupled to the third feed port 110, also comprises a quarter-wavelength PILA type antenna structure disposed proximate to the opposite corner of the PCB 102 from the first PILA element 112. The other radiator element 116 is disposed between the PILA radiators 112 and 114, and is coupled to the second feed port 108. This third radiator 116 comprises a half wavelength loop-type antenna structure positioned proximate the (bottom) end of the PCB 102 and coupled to a ground point 118. The ground plane 104 is disposed as to reside substantially beneath the three radiator elements 112, 114, and 116. In the embodiment of FIG. 1A, the radiator elements 112, 114, 116 are formed as to have a ground clearance of approximately 9 mm (0.35 in.) parallel with the ground plane 104, although this value may be varied as desired or dictated by the application.

In one exemplary variant, the radiators elements 112, 114, and 116 are further configured to be bent over the edge of the device (as shown in FIG. 1A), thereby providing for improved coupling to the chassis modes, and maximizing impedance bandwidth. It will be appreciated that the placement of the antenna radiators 112, 114, and 116 can be chosen based on the device specification. However, the top or bottom edges are generally recognized to be the best locations for coupling to the chassis mode, thereby increasing antenna performance through maximizing impedance bandwidth (which is of particular importance for receiving lower frequencies such as the Low Band (700-960 MHz) within space-constrained devices).

The radiators 112, 114, and 116 of FIG. 1A can be fabricated using any of a variety of suitable methods known to those of ordinary skill, including for example metal casting, stamping, metal strip, or placement of a conductive coating disposed on a non-conductive carrier (such as plastic).

In the implementation shown in FIG. 1A, each radiator 112, 114, 116 is configured to resonate in a separate frequency range; i.e., the first (low band), third (high-band), and second range (B7, B11, B40), respectively. In another implementation of the multi-feed antenna (not shown), two of the feed ports (for example the ports 108, 106) share the same antenna radiator element. In one such variant, the single antenna (such as the antenna 116) is used to cover the 1 GHz and the 2 GHz frequency regions. As a brief aside, in sharing a single antenna, a diplexer may be used between the antenna and the antenna switches so as to prevent the duplexers from overloading each other, and thereby increasing insertion loss. However, the modularity (i.e., separability or ability to be replaced) of the RF front-end remains in such cases, as there is no need for band-pair specific duplexer matching (thereby obviating a specifically matched RF front-end). Therefore, different 1 GHz and 2 GHz carrier aggregation band pairs may be still supported with the same RF hardware configuration. Wireless operators of LTE-A networks desire a worldwide LTE roaming capability which typically requires carrier aggregation. Exemplary embodiments of the triple-feed antenna described supra advantageously provide a single antenna solution that covers all the required LTE frequency bands, thus satisfies carrier aggregation needs.

Figure 1B:
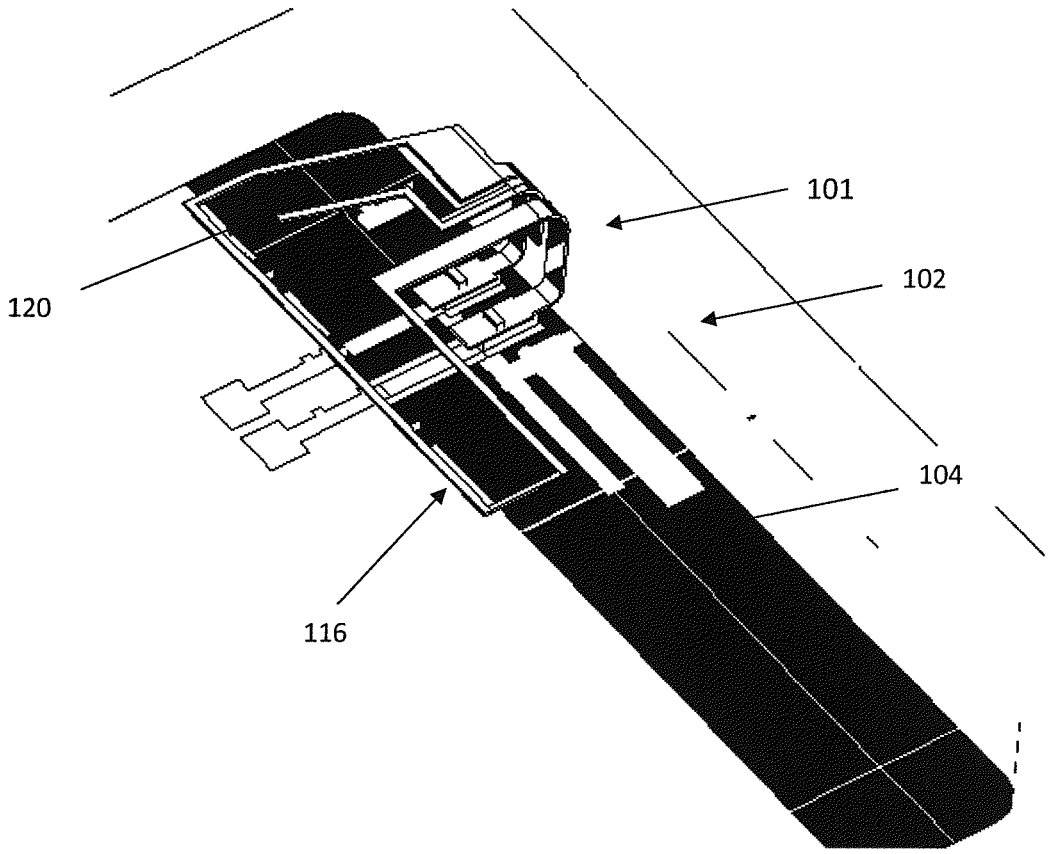
FIG. 1B is an isometric view showing the loop-type radiator of the antenna apparatus embodiment shown in FIGS. 1 and 1A.

Referring now to FIG. 1B, a three-dimensional representation of the exemplary loop-type antenna radiator 116 described above is shown in detail. In one variant, the radiator 116 further comprises a slot-type structure 120 disposed within the loop assembly of the radiator 116, which is designed to enable antenna resonance at an additional desired frequency (for example, 23 GHz), thereby expanding the operational frequency range of the radiator element 116.

The placement of the loop-type antenna structure 116 between the two PILA antenna structures 112 and 114 as shown in FIG. 1A enhances isolation between the three antenna feeds. By way of background, a small loop (having a circumference that is smaller than one tenth of a wavelength) is typically referred to as a "magnetic loop", as the small loop size causes a constant current distribution around the loop. As a result, such small loop antennas behave electrically as a coil (inductor) with a small but non-negligible radiation resistance due to their finite size. Such antennas are typically analyzed as coupling directly to the magnetic field in the near field (in contrast to the principle of a Hertzian (electric) dipole, which couples directly to the electric field), which itself is coupled to an electromagnetic wave in the far field through the application of Maxwell's equations. In other words, the radiation pattern of the exemplary loop antenna structure 116 shown is similar to the radiation pattern of a magnetic dipole, with the axis of maximum radiation being perpendicular to the loop plane (i.e., along the z-dimension in FIG. 1A). Radiation patterns for the PILA antenna structures 112, 114 are similar to the radiation pattern of an electric dipole, with the axis of maximum radiation being parallel to the loop plane (along the x-dimension in FIG. 1A).

By placing the loop antenna structure 116 between the two PILA antenna structures 112, 114, the field ports achieve high isolation between the first and the third antenna structures. In addition, due to the orthogonal polarization of the loop 116 antenna and PILA antenna 114, the coupling between the antenna structures 114, 116 is greatly reduced (especially when considering the relative proximity of their operating frequency bands), thereby providing sufficient isolation between the frequency bands corresponding to the two antennas (for example a −12 dB isolation between 2.1 GHz and 2.3-2.6 GHz bands).

Referring now to FIG. 2, a top elevation view of the antenna assembly 101 is shown. The dark areas in FIG. 2 depict an antenna carrier 202 configured to support the conductive elements of antenna radiators 112, 114, 116. In one variant, the carrier 202 is fabricated from polycarbonate/acrylonitrile-butadiene-styrene (PC-ABS) that provides, inter alia, desirable mechanical and dielectric properties, although other suitable materials will be apparent to those of ordinary skill given the present disclosure. The slot structure 120 is denoted in FIG. 2 by the broken line curve.

Figure 2A:
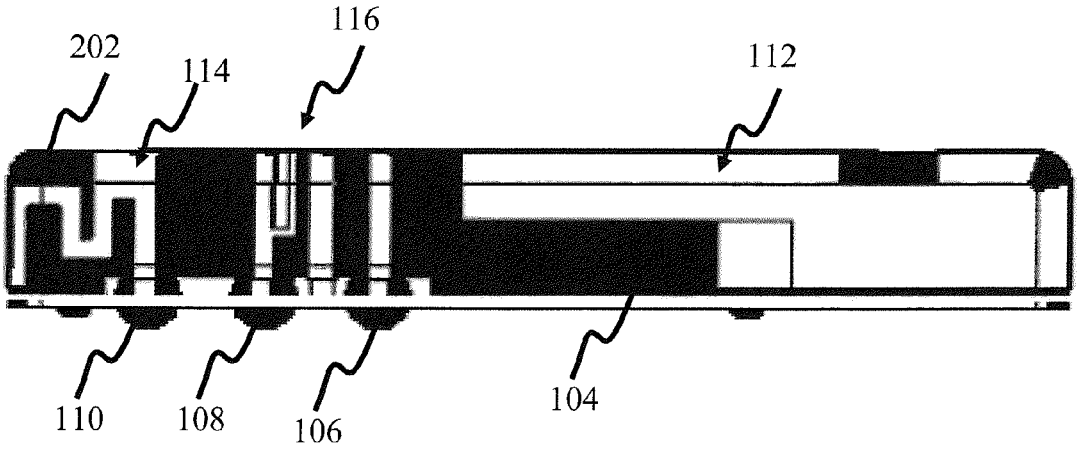
FIG. 2A is a side elevation view of the carrier and radiating elements of triple-feed antenna apparatus shown in FIG. 2.

FIG. 2A depicts a side elevation view of the antenna assembly 101 of FIG. 2. The antenna carrier 202 provides support for the radiator elements 112, 114, and 116, as well as providing the desired dielectric characteristics between the radiator elements 112, 114, and 116 and the ground plane 104.

Figure 3:
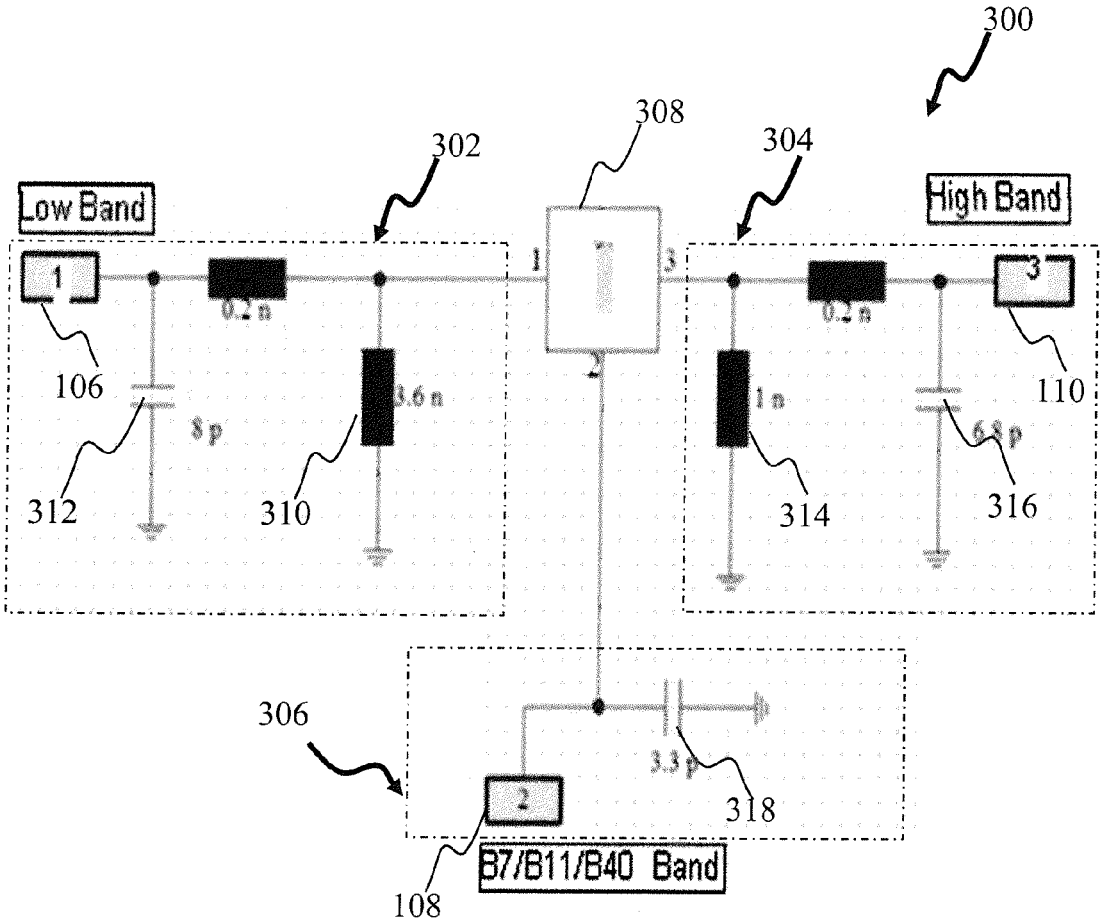
FIG. 3 is a circuit diagram of the triple-feed matching circuitry in accordance with one embodiment of the present invention.

In another aspect of the invention, the triple-feed antenna assembly (such as the antenna assembly 101 of FIG. 1) comprises a matching network 300, one embodiment of which is illustrated in FIG. 3. The matching network 300 comprises the matching circuits 302, 304, 306 that are configured to couple the RF-front end 308 to the three feed ports 106, 108, 110 of the RF front-end. The purpose of the matching network 300 is to, inter alia, (i) enable precise tuning of the antenna radiators to their desired frequency bands; (ii) provide accurate impedance matching to the feed structure of the transceiver by increasing the input resistance of the feed ports 106, 108, 110 (for instance, in one implementation, to be close to 50 Ohms); and (iii) acts as band-pass filters ensuring low coupling between the radiators. The matching circuits 302, 304, 306 of the network 300 are configured to effectively filter out the higher-order cellular harmonics in a deterministic way.

By a way of example, PILA antenna radiators 112, 114 typically do not offer 50-Ohm impedance (radiational resistance) at their respective resonant frequencies F1, F3, as is desired for proper matching to the feed ports 106, 110. Hence, the matching network 300 is used to match the radiators 112, 114 to the feed ports as follows. The matching component of the circuits 302, 304 is selected to have resonances at frequencies Fm1=F1+X1, Fm3=F3+X3. In one variant, the frequencies Fm1, Fm3 are configured on exactly the opposite side of a Smith chart, with respect to frequencies F1, F3. The actual values of the frequency shift X1, X3 are determined by the respective antenna operating bands: i.e. LB/HB. In combination with the antenna radiators 112, 114, the matching circuits 302, 304 form a "dual resonance" type frequency response. Such frequency response effectively forms a band pass filter, advantageously attenuating out-of-band signal components and, hence, increasing band isolation. By way of example, the circuit 302 passes the LB signals and attenuates the HB/B7 signals, while the circuit 304 passes the HB signals and attenuates the LB/B7 signals.

The antenna 112, 114 isolation is further enhanced by the placement of the feed port 108 in-between the feed ports 106, 110. The use of a loop antenna structure (e.g., the structure 116) coupled to the feed port 108 further increase isolation between the feed ports 106, 110. Furthermore, the loop structure coupled to the fed port 108 enables to achieve high isolation between the feed port 108 and the radiators 112, 114.

In another embodiment, a PILA radiator structure is coupled to the feed-port 108 in place of the loop structure 116. Such configuration advantageously increases the isolation between the feed ports 106, 110. However, the feed 108 to radiator 112, 114 isolation may be reduced when the frequency band spacing (gap) between the HB and the feed port 108 frequency band becomes narrow, as illustrates by the examples below.

Example 1

Feed port 106: LB (PILA), feed port 108: 2.5-23 GHz (PILA), feed port 110: HB (PILA). This configuration provides sufficient feed to radiator isolation between the feed ports 108 and 110 due to a wide frequency gap (about 200 MHz) between the feed port 108 and 110 frequency bands.

Example 2

Feed port 106: LB (PILA), feed port 108: 2.3-2.7 GHz (PILA), feed port 110: HB (PILA). This configuration does not provide sufficient feed to radiator isolation between the feed ports 108 and 110 due to a small frequency gap (about few MHz) between the feed port 108 and 110 frequency bands.

Example 3

Feed port 106: LB (PILA), feed port 108: 2.3-2.7 GHz (Loop), feed port 110: HB (PILA). This configuration provides very good feed to radiator isolation for all feed ports in all frequency bands despite a small frequency gap between the feed ports 108 and 110 frequency bands.

In one embodiment, the matching circuits for the first and third feed ports are realized through use of tapped inductors 310, 314, respectively. The inductor 310, 314 are implemented, in one variant, as narrow conductive traces on the PCB, configured to achieve the desired inductance values. In another variant, the inductors 310, 314 are implemented using discrete components, e.g. chip inductors, wound toroids, ceramic multilayer, and wire-wound inductors, etc. Residual reactance of the circuits 302, 304 can be tuned with the shunt capacitors 312, 316, respectively, so as to create a dual resonance type of response in the first and third feed ports 106, 108. The matching circuit 308, corresponding to the feed port 108, is properly matched over the target frequency range using a shunt capacitor 318. In other implementations, additional matching components may be used expand the resonance response of the radiators 112, 114, and 116 in order to cover additional desired frequency bands.

In order to minimize space occupied by the antenna assembly 101 of FIG. 1, the matching network 300 of the illustrated embodiment is directly fabricated on the lower portion of the PCB substrate 102. In other implementation, the matching network is disposed.

Figure 4:
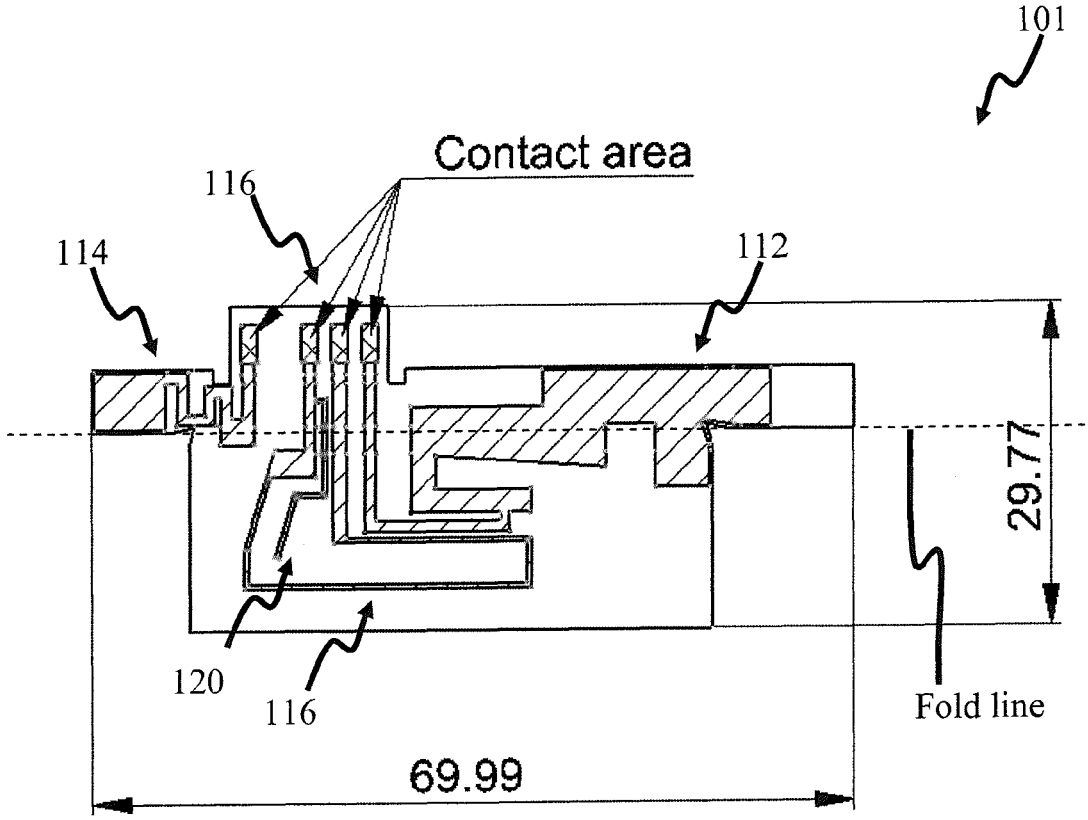
FIG. 4 is a top elevation view detailing a rolled-out structure of the radiating elements of the of the triple-feed antenna apparatus accordance with one embodiment of the present invention.

Referring now to FIG. 4, a "rolled out" (i.e., flattened) view of the antenna radiator structure 101 of the embodiment of FIGS. 1A, and 2-2A is shown in detail. Specifically, FIG. 4 more clearly illustrates the shape and disposition of the antenna radiators of the exemplary device as shown and described, supra, with respect to FIG. 1A. The dashed line in FIG. 4 denotes the fold line, used to fold the antenna radiator assembly around the carrier 202, as shown in FIGS. 2-2A herein. In addition, the slot type element 120 (part of the loop-type radiator 116) can be more clearly viewed.

In one exemplary implementation, the radiator elements 112, 114, and 116 are fabricated using stamped metal sheet of approximately 70 mm (2.76 in.) in length and 30 mm (1.18 in.) in width, although these dimensions may vary depending on the application and desired performance attributes. It is appreciated by those skilled in the arts that other fabrication approaches and/or materials are compatible with the invention including without limitation use of flex circuits, metal deposition, plated plastic or ceramic carrier, or yet other technologies.

Performance

Figure 5:
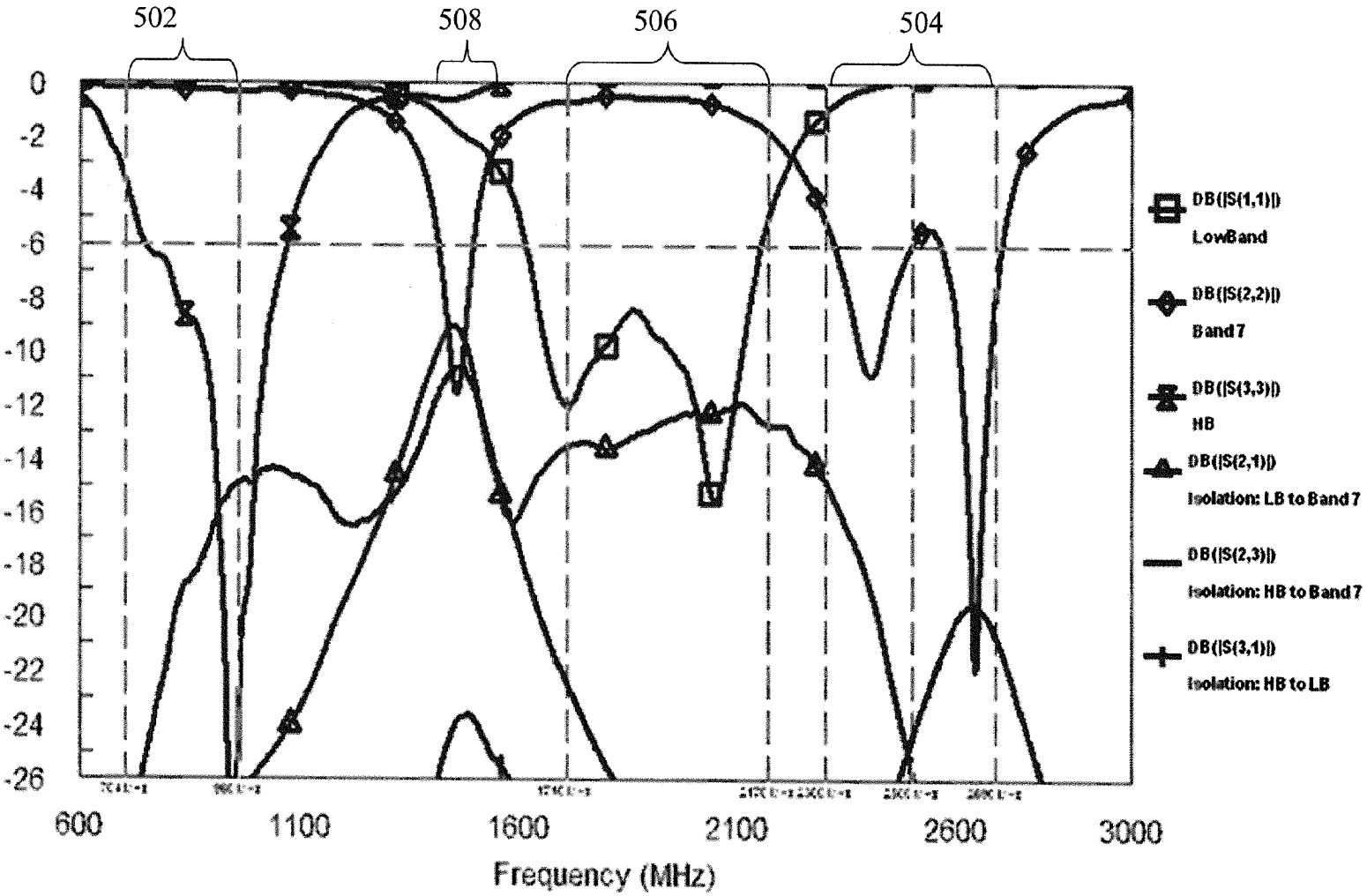
FIG. 5 is a plot of measured free space input return loss for the three antenna structure in addition to the isolation between the triple-feed ports in accordance with one embodiment of the present invention.
Figure 6:
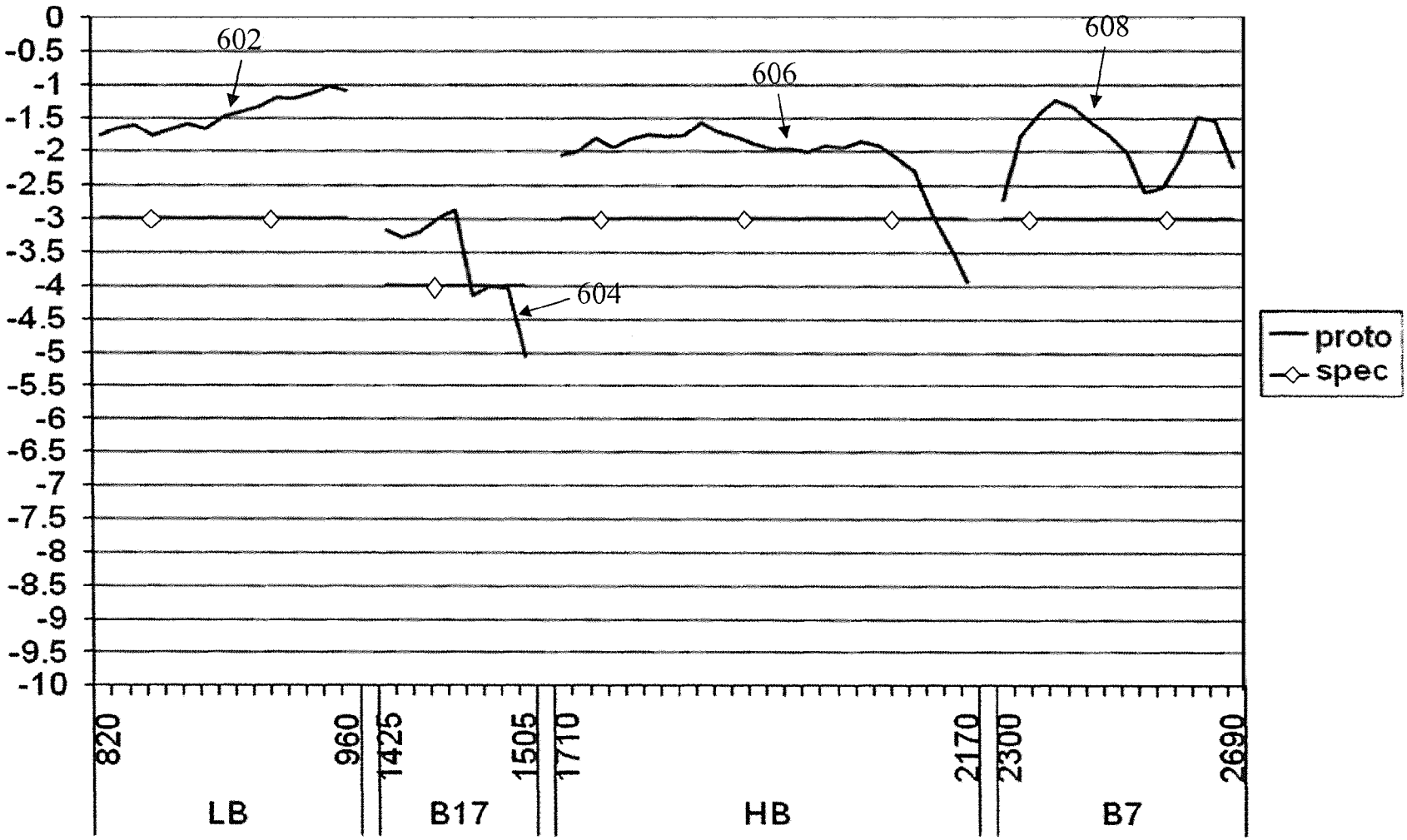
FIG. 6 is a plot of total efficiency (measured across the low band, B17 band, high band, and B7 band) for three exemplary antenna configurations in accordance with one embodiment of the present invention.

Referring now to FIGS. 5 through 6, performance results obtained during testing by the Assignee hereof of an exemplary antenna apparatus constructed according to the invention are presented.

FIG. 5 shows a plot of (i) free-space return loss S11, S22, and S33 (in dB) as a function of frequency, measured with the three antenna structures constructed in accordance with the triple-feed antenna apparatus 100 of FIG. 1 discussed supra, as well as (ii) the isolation between the respective three feed ports 106, 108, and 110. The vertical lines of FIG. 5 denote the low band 502, high band 504, B11 frequency band 508, and B7 frequency band 506, respectively. The return loss data clearly show the exemplary antenna configuration forming several distinct frequency bands from 600 MHz to 3000 MHz, with the respective antenna radiators showing acceptable return loss within their respective bands 502, 504, and 506. In addition, the data clearly shows strong isolation between the first feed port 106 and the third feed port 110, as well as good isolation between the first feed port 106 and second feed port 108, and between the second port 108 and third feed port 110.

FIG. 6 presents data regarding total efficiency for the low band, B7/B17 band, and high band triple-feed antenna apparatus 100 as described above with respect to FIG. 1. In addition, FIG. 6 provides reference to the minimum total efficiency requirement as listed by the LTE/LTE-A specification for the aforementioned designated frequency bands. Antenna efficiency (in dB) is defined as decimal logarithm of a ratio of radiated and input power:

$$AntennaEfficiency[\text{dB}] = 10\log_{10}\left(\frac{\text{Radiated Power}}{\text{Input Power}}\right) \quad \text{Eqn. (1)}$$

An efficiency of zero (0) dB corresponds to an ideal theoretical radiator, wherein all of the input power is radiated in the form of electromagnetic energy. The data in FIG. 6 clearly demonstrates that the first radiator 112 yields high efficiency, as indicated by curve 602. The second radiator 114 yields acceptable efficiency over the designated B17 and B7 bands, as indicated by curve 604 and curve 608. Lastly, the third radiator 116 yields good efficiency over the high band, as illustrated by curve 606. The data in FIG. 6 illustrate that the triple feed antenna embodiments constructed according to the invention advantageously require only minimal amount of tuning in order to satisfy the total efficiency requirements. As will be understood, these efficiency results discussed supra provide only an indication of achievable antenna performance and may change based on specific implementation and design requirements.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A triple-feed antenna apparatus, comprising:

a first antenna element operable in a lower frequency band and comprising a first feed portion configured to be coupled to a first feed port;

a second antenna element operable in a second frequency band and comprising a second feed portion configured to be coupled to a second feed port;

a third antenna element operable in an upper frequency band and comprising a third feed portion configured to be coupled to a third feed port; and a ground plane, the ground plane disposed so as to reside substantially beneath the first, second, and third antenna elements;

wherein:

the first and third antenna elements are each configured to form a radiation pattern disposed primarily in a first orientation;

the second antenna element is configured to form a radiation pattern disposed primarily in a second orientation that is substantially orthogonal to the first orientation; and the second antenna element comprises a loop structure configured to have a radiator branch disposed within the loop structure, the radiator branch configured to resonate at a frequency that expands an operational frequency range of the second frequency band.

2. The antenna apparatus of claim 1, further comprising a matching network comprised of:

a first circuit coupled between a radio-frequency (RF) front end of assembly host transceiver and said first feed port;

a second circuit coupled between said RF front end and said second feed port; and a third circuit coupled between said RF front end and said third feed port.

3. The antenna apparatus of claim 2, wherein:

said first and said second circuits cooperate to reduce electromagnetic coupling between a radiating structure of the first antenna element and a radiating structure of the second antenna element; and said third and said second circuits cooperate to reduce electromagnetic coupling between a radiating structure of said third antenna element and a radiating structure of said second antenna element.

4. The antenna apparatus of claim 1, wherein:

said first, second and third antenna elements are disposed on a common carrier, at least a portion of the common carrier configured to be substantially parallel to said ground plane;

the radiation pattern of the first and third antenna elements each comprise an axis of maximum radiation that is substantially perpendicular to said ground plane; and the radiation pattern of the second antenna element comprises an axis of maximum radiation substantially parallel to said ground plane.

5. The antenna apparatus of claim 4, wherein the disposition of said axes of maximum radiation of the first, the second, and the third antenna elements enable electrical isolation of the first antenna element from said third antenna element.

6. The antenna apparatus of claim 4, wherein the disposition of said axes of maximum radiation of the first, the second, and the third antenna elements enable substantial electrical isolation between:

the first antenna element and said third antenna element;

the first antenna element and said second antenna element; and the second antenna element and said third antenna element.

7. The antenna apparatus of claim 1, wherein the first antenna element and the third antenna element each comprise a quarter-wavelength planar inverted-L antenna (PILA); and said second antenna element comprises a half-wavelength loop antenna.

8. The antenna apparatus of claim 1, wherein said radiating branch and said loop structure are configured to be spaced apart yet parallel to said ground plane of the antenna apparatus.

9. The antenna apparatus of claim 1, further comprising a common carrier, said common carrier comprising a dielectric element having a plurality of surfaces, and wherein:

the first antenna element and the third antenna element are disposed at least partly on a first surface of said plurality of surfaces; and the second antenna element is disposed at least partly on a second surface of said plurality of surfaces, said second surface being disposed substantially parallel to said ground plane of the antenna apparatus, and said first surface is disposed substantially perpendicular to said ground plane.

10. The antenna apparatus of claim 9, wherein:

said first antenna element is disposed proximate a first end of said first surface; and said third antenna element is disposed proximate a second end of said first surface, said first end being disposed opposite said second end.

11. The antenna apparatus of claim 10, wherein:

said first antenna element is disposed at least partly on a third surface of said plurality of surfaces, said third surface proximate said first end; and said third antenna element is disposed at least partly on a fourth surface of said plurality of surfaces, said fourth surface proximate said second end.

12. A radio frequency communications device, comprising:

an electronics assembly comprising a ground plane and one or more feed ports; and a multiband antenna apparatus, the antenna apparatus comprising:

a first antenna structure disposed above the ground plane and comprising a first radiating element and a first feed portion coupled to a first feed port;

a second antenna structure disposed above the ground plane and comprising a second radiating element and a second feed portion coupled to a second feed port;

a third antenna structure disposed above the ground plane and comprising a third radiating element and a third feed portion coupled to a third feed port; and wherein:

the second antenna structure and second feed port are disposed substantially between said first and third antenna structures;

the second antenna element comprises a loop structure configured to have a radiator branch disposed within the loop structure, said radiator branch configured to resonate at a frequency which expands an operational frequency range of the second frequency band; and the first and third radiating elements have radiation patterns which are substantially orthogonal to a radiation pattern of the second radiating element.

13. The radio frequency communications device of claim 12, wherein said antenna apparatus is disposed proximate a first end of the ground plane.

14. The radio frequency communications device of claim 12, wherein said radiation patterns of said first, second, and third radiating elements provide sufficient antenna isolation between each radiating element to enable operation of the device in at least three distinct radio frequency bands.

15. A method of radiator isolation for use in a multi-feed antenna apparatus of a radio frequency device, the antenna comprising first, second, and third antenna radiating elements, and at least first, second, and third feed portions, the method comprising:

electrically coupling the first feed point to the first radiating element, said coupling configured to effect a first radiation pattern having maximum sensitivity along a first axis;

electrically coupling the second feed point to the second radiating element comprising a loop structure disposed in parallel above a ground plane, the second radiating element having a radiator branch disposed within the loop structure, said electric coupling configured to effect a second radiation pattern having maximum sensitivity along a second axis; and electrically coupling the third feed portion to the third radiating element, said coupling configured to effect a third radiation pattern having maximum sensitivity along said first axis;

wherein:

said second axis is configured orthogonal to said first axis;

said configurations cooperate to effect isolation of the first radiating element from the third radiating element; and the radiator branch configured to resonate at a frequency which expands an operational frequency range of the second radiating element.

16. A multi-feed antenna apparatus, comprising:

a first antenna element comprising a first quarter-wavelength planar inverted-L antenna (PILA) operable in a lower frequency band and comprising a first feed portion configured to be coupled to a first feed port;

a second antenna element comprising a half-wavelength loop antenna disposed substantially above a ground plane and being operable in a second frequency band and comprising a second feed portion configured to be coupled to a second feed port; and a third antenna element comprising a second quarter-wavelength PILA operable in an upper frequency band and comprising a third feed portion configured to be coupled to a third feed port;

wherein the second antenna element is disposed substantially between the first and third antenna elements, and comprises a loop structure configured to have a radiator branch disposed within the loop structure, the radiator branch configured to resonate at a frequency that adds to an operational frequency range of the second frequency band; and wherein the placement of the half-wavelength loop antenna between the first and second quarter-wavelength PILA is configured to achieve a high isolation between the first and second quarter-wavelength PILA.

* * * * *